United States Patent [19]

Paisley

[11] Patent Number: 5,046,423

[45] Date of Patent: Sep. 10, 1991

[54] LASER-DRIVEN FLYER PLATE

[75] Inventor: Dennis L. Paisley, Santa Fe, N. Mex.

[73] Assignee: The United States of America as represented by the Department of Energy, Washington, D.C.

[21] Appl. No.: 502,956

[22] Filed: Apr. 2, 1990

[51] Int. Cl.[5] ..... F42C 19/08; F42B 3/113

[52] U.S. Cl. ..... 102/201

[58] Field of Search ..... 102/201; 370/125, 152

[56] References Cited

U.S. PATENT DOCUMENTS

| | | | |
|---|---|---|---|
| 3,528,372 | 9/1970 | Lewis et al. | 102/201 |
| 3,812,783 | 5/1974 | Yang et al. | 102/201 |
| 4,870,903 | 10/1989 | Carel et al. | 102/201 |

OTHER PUBLICATIONS

M. E. Kipp, R. E. Setchell and P. A. Taylor, "Homeogeneous Reactive Kinetics Applied to Grandular HNS," Shock Waves in Condensed Matter, pp. 539–542 (1987).

V. P. Ageev, A. D. Akhsakhalyan, S. V. Gapono, A. A. Gorbunov, V. I. Konov, and V. I. Lucin, "Influence of the Wavelength of Laser Radiation on the Energy Composition of an Ablation Plasma," Published in the Soviet, Phys., Thec., Thys., vol. 33, No. 5, pp. 562–565 (May 1988).

S. A. Sheffield and G. A. Fisk, "Particle Velocity Measurements of Laser-Induced Shock Waves Using Orvis," Proceedings of SPIE vol. 427, p. 193 (Aug. 1983).

S. A. Sheffield, J. W. Rogers, Jr., and J. N. Castaneda, "Velocity Measurements of Laser-Driven Flyers," American Phys. Society (1985), Topical Conference on Shock Waves in Condensed Matter (Jul. 1985).

S. A. Sheffield and G. A. Fisk. "Particle Velocity Measurements in Laser" Irradiated Foils Using ORVIS, Published in Shockwaves in Condensed Matter, Chapter VI:7 (1983).

S. P. Obenschain, R. R. Whitlock, E. A. McLean and B. H. Auerbach, "Uniform Ablative Acceleration of Targets by Laser Irradiation at $10^{14}$ W/cm$^2$," Physical Review Letters, vol. 50, No. 1, pp. 44–48 (Jan. 1983).

J. Grun, S. P. Obenschain, B. H. Ripin, R. R. Whitlock, E. A. McLean, J. Gardner, M. J. Herbst, and J. A. Stamper, "Ablative Acceleration of Planar Targets to High Velocities," Published in Phys. Fluids vol. 26, No. 2, pp. 588–597 (Feb. 1983).

D. D. Bloomquist and S. A. Sheffield, "Optically Recording Interferometer for Velocity Measurements with Subnanosecond Resolution," J. Appl. Phys. vol. 54, No. 4 (Apr. 1983).

F. Cottet and J. P. Romain, "Formation and Decay of Laser-Generated Shock Waves," Phys. Review A, vol. 25, No. 1, pp. 576–579 (Jan. 1982).

B. H. Ripin, R. Decoste, S. P. Obenschain, S. E. Bodner, E. A. McLean, F. C. Yount, R. R. Whitlock, C. M. Armstrong, J. Grun. J. A. Stamper, S. H. Gold, J. Nagel, R. H. Lehmberg, and J. M. McMahon, "Laser--Plasma Interaction and Ablative Acceleration of this Foils at $10^{12}$ -$10^{15}$ W/cm$^2$, " Phys. Fluids, vol. 23, No. 5, pp. 1012–1026 (May 1980).

L. R. Veeser, J. C. Solem and A. J. Lieber, "Impedance-Match Experiments Using Laser-Driven Shock Waves," Appl. Phys. Lett. vol. 35, No. 10, pp. 761–763 (Nov. 1979).

(List continued on next page.)

*Primary Examiner*—Charles T. Jordan

*Attorney, Agent, or Firm*—Milton D. Wyrick; Paul D. Gaetjens; William R. Moser

[57] ABSTRACT

Apparatus for producing high velocity flyer plates involving placing a layer of dielectric material between a first metal foil and a second metal foil. With laser irradiation through an optical substrate, the first metal foil forms a plasma in the area of the irradiation, between the substrate and the solid portion of the first metal foil. When the pressure between the substrate and the foil reaches the stress limit of the dielectric, the dielectric will break away and launch the flyer plate out of the second metal foil. The mass of the flyer plate is controlled, as no portion of the flyer plate is transformed into a plasma.

5 Claims, 2 Drawing Sheets

OTHER PUBLICATIONS

R. J. Trainor, J. W. Shaner, J. M. Auderbach, and N. C. Holmrd, "Ultrahigh-Pressure Laser-Driven Shock--Wave Experiments in Aluminum," Phys. Review Letters, vol. 42, No. 17, pp. 1154-1157 (Apr. 1979).

B. P. Fairand and A. H. Clauer, "Laser Generation of High-Amplitude Stress Waves in Materials," J. Appl. Phys. vol. 50, No. 3, pp. 1497-1502 (Mar. 1979).

P. Krehl, F. Schwirzke and A. W. Cooper, "Correlation of Stress-Wave Profiles and the Dynamics of the Plasma Produced by Laser Irradiation of Plane Solid, Targets," J. Appl. Phys. vol. 46, No. 10, pp. 4400-4406.

S. A. Sheffield, J. W. Rogers, and J. N. Castaneda, "Velocity Measurements of Laser-Driven Flyers Back by High Impedance Windows," Shock Waves in Conensed Matter, pp. 541-546 (1986).

D. L. Paisley, N. I. Montoya, D. B. Stahl and I. A. Garcia, "Interferometry and High Speed Photography of Laser-Driven flyer Plates," Los Alamos National Laboratory Document LA-UR-89-2657 (Submitted to SPIE, High Speed Photography and Photonics).

D. L. Paisley, "Laser-Driven Miniature Flyer Plates for Shock Initiation of Secondary Explosives," Los Alamos National Laboratory Document LA-UR-8-9-2723 (Submitted to APS-Shock Waves in Condensed Matter-1989, Albuquerque, N. Mex., Aug. 14-17, 1989).

LASER-DRIVEN FLYER PLATE

BACKGROUND OF THE INVENTION

The present invention generally relates to the field of explosive detonation and inertial confinement research, and more specifically to the use of flyer plates to detonate explosives and drive fusion reactions. The invention is a result of a contract with the Department of Energy (Contract No. W-7405-ENG-36).

Flyer plates have been used for detonating explosives since their invention in the late 1960's. Originally, these flyer plates were electrically operated, utilizing an electrically produced plasma to accelerate the plate. It was subsequently discovered, after development of the laser, that laser induced plasmas could be used for plate acceleration.

Current laser initiated explosives or energetic materials operate by either of two methods: thermal runaway, or exploding a metal film to generate a high temperature in a manner similar to an exploding bridgewire. The first of these, thermal runaway, is a slow process requiring a period ranging from several hundred microseconds to several milliseconds to attain plate acceleration. Additionally, thermal runaway requires the addition of undesirable additives to the energetic material in order to reduce energy and thermal requirements to a practical level. The second, the exploding metal film, is effective for low density ($\approx$0.5 Theoretical Maximum Density-TMD) secondary explosives, but is not effective to produce detonation at reasonable energies for high density ($\approx$0.9 TMD) explosives.

There is currently significant interest in inertial confinement fusion, where large amounts of energy are directed at a sphere of fuel. Although laser beams are now being used in testing, it is conceivable that multiple flyer plates could be shot at the fuel sphere, or that an imploding flyer plate could be on the fuel sphere. The flyer plate may reduce or eliminate the pre-heat problem with large high power lasers. The invention also finds application in one-dimensional impact of metals or other materials used in shock physics and high strain rate materials research.

The basic prior process for accelerating foils by laser beams involves focusing a laser beam on a free-standing foil in order to convert a portion of the thickness of the foil into a plasma. This plasma will drive a segment of the foil toward a target. Conventional laser interaction with metals produces penetration of the laser beam into the metal of only a few hundred angstroms. The energy deposited in the metal by the laser results in formation of a plasma within a few nanoseconds This metal plasma expands and continues to absorb the incoming laser energy, and may continue to convert more of the metal foil to plasma. The plasma expansion decouples the remaining laser pulse energy from the metal surface, resulting in low efficiency energy transfer from the laser to the metal foil. Because of this, the thickness of the foil remaining in the solid phase is uncertain and uncontrolled. Too great a conversion of the metal foil to a plasma may result in insufficient kinetic energy being delivered to the target.

The present invention solves these problems, and can control the thickness of the foil fired toward the target. The invention can also provide higher velocity flyer plates, thereby transferring a higher level of kinetic energy to the target.

It is therefore an object of the present invention is to provide laser launched flyer plates of a determinable mass.

It is another object of the present invention to provide flyer plates which will transfer a high amount of kinetic energy to a target.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

To achieve the foregoing and other objects, and in accordance with the purposes of the present invention, as embodied and broadly described herein, the apparatus of this invention for producing a flyer plate from laser irradiation comprises a substrate transparent to said laser irradiation having a first metal foil deposited onto the substrate. A layer of dielectric material is deposited onto the first metal foil and a second metal foil is deposited onto the layer of dielectric material.

BRIEF DESCRIPTION OF THE DRAWINGS

The accompanying drawings, which are incorporated in and form a part of the specification, illustrate the embodiments of the present invention and, together with the description, serve to explain the principles of the invention. In the drawings.

DETAILED DESCRIPTION

Figure 1:
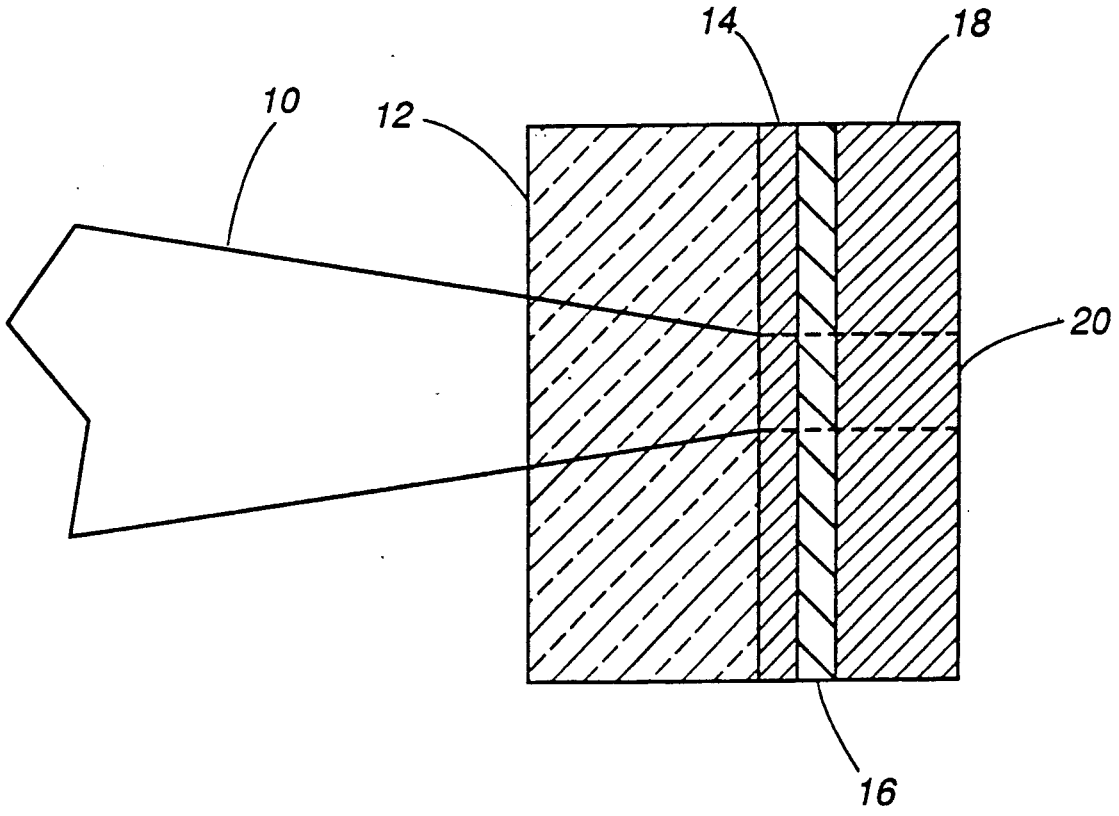
FIG. 1 is a schematical cross-section of the components of the present invention.

The present invention provides laser driven flyer plates which have a controlled mass, and can deliver higher kinetic energy to a target through higher mass and greater velocity. Reference to FIG. 1 will reveal how these improvements are achieved. In Figure where relative thicknesses are exaggerated for clarity, a schematic drawing is presented where focused laser beam 10 is shown focused on sacrificing metal foil 14 after passing through optical window 12. Laser beam 10 may be produced by a Neodynium-YAG laser capable of producing energies in the range of 20–300 millijoules, with pulse duration of approximately 5–30 nsec in order to deposit approximately 0.75 GW/cm$^2$ to 4.0 GW/cm$^2$. However, the type and output frequency of the laser is not overly important. Optical window 12 could as well be in the form of a support or confinement substrate as long it is transparent to energy from laser 10. In one embodiment, optical window 12 is made of UV-quartz and is 2–3 mm thick.

Metal foil 14 has a thickness of a few tenths of a micron, and can be any one of numerous metals. In one embodiment, metal foil 14 is aluminum.

Deposited onto metal foil 14 is dielectric layer 16. Dielectric layer 16 may be an aluminum oxide layer, a few tenths of a micron thick. However, any refractory dielectric having high ionization potential, high shear strength, and low thermal conductivity could also be used. Although FIG. 1 depicts metal foil 14 and dielectric layer 16 as having equal thicknesses, there is no requirement that this be the case. The thicknesses of metal foil 14 and dielectric layer 16 are independent of one another, and can vary to meet any desired parameters.

Metal plate 18 is deposited onto dielectric layer 16, and is a metallic foil having a thickness of approximately 2–10 microns. Like metal foil 14, metal plate 18 may comprise any one of many metals. In one embodiment, metal plate 18 is aluminum.

In operation, laser 10, being focused to a spot diameter of 0.2–3.0 mm on metal layer 14, will, within a few nanoseconds, convert a portion of layer 14 onto which it is incident into a plasma. However, due to the higher ionization potential of dielectric layer 16, the plasma will be isolated from metal plate 18 until dielectric layer 16 shears from the pressure created between optical window 12 and dielectric layer 16 by the plasma. When dielectric layer 12 shears, it shears flyer plate 20 from metal plate 18, and launches it toward a target (not shown). Much of the energy from laser 10 goes into the plasma from metal layer 14, but the mass of launched flyer plate 20 is not diminished.

The power deposited onto metal layer 14 by laser beam 10 must be on the order of 0.75–4.0 $GW/cm^2$ typically at the interface between optical window 12 and metal layer 14 in order to achieve the necessary pressure and temperature to produce and maintain a plasma from a portion of metal layer 14. With these pressures, on the order of approximately 5–20 Kbar or greater, maintained for a few nanoseconds, the area of dielectric layer 16 adjacent to the plasma will yield and will force flyer plate 20 out of metal plate 18 toward a target. Actually, any remaining solid portion of metal layer 14 onto which laser beam 10 was incident, and the adjacent portion of dielectric layer 16 will also be launched along with flyer plate 20.

Testing has shown that the type of laser used to produce laser beam 10 is not particularly important. The primary requirement is that the laser be capable of outputting a pulse several nanoseconds long, at energies ranging from approximately 30–300 millijoules. Laser wavelengths of 500 nm to 1 micron will perform satisfactorily, with an approximate 20%–30% difference in the time required to eject flyer plate 20, depending on the metal used for metal layer 14. This is a small difference at the time scale of flyer plate launching.

Figure 2:
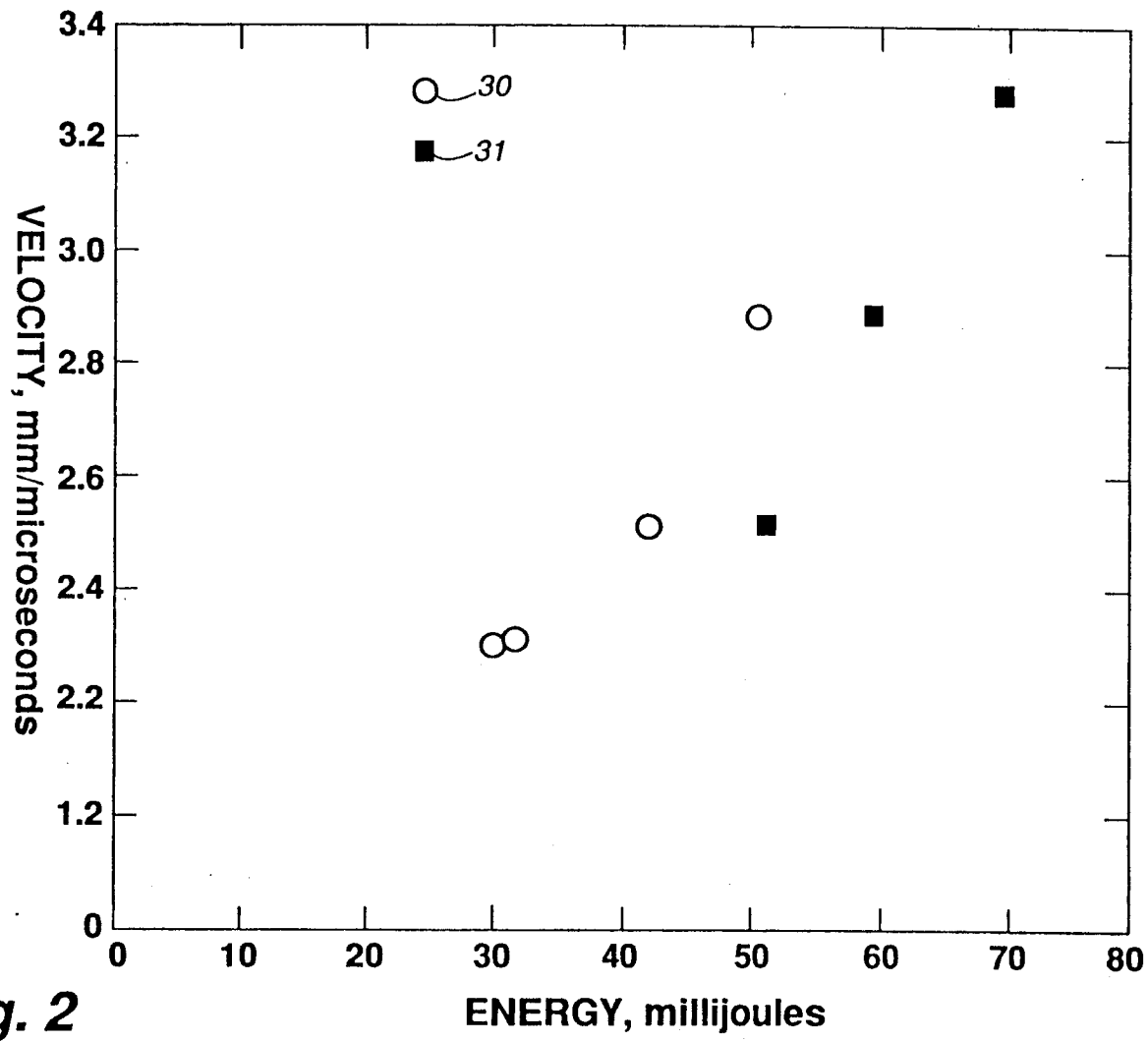
FIG. 2 is two curve plot of velocity versus energy for flyer plates according to the present invention and flyer plates from free standing foils.

FIG. 2 is a plot of velocities versus energy for flyer plates according to the present invention. Circles 30 represent data points for flyer plates originating from only a conventional foil. Squares 31, represent data points for conventional metal flyer plates. These data were obtained from testing. As seen in FIG. 2, flyer plates according to the present invention achieved velocities approximately 16% higher, and energies (varying as the square of the velocity) approximately 34% higher than those from only single layer foils.

The foregoing description of embodiments of the invention have been presented for purposes of illustration and description. It is not intended to be exhaustive or to limit the invention to the precise forms disclosed, and obviously many modifications and variations are possible in light of the above teachings. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. Apparatus for producing a flyer plate from laser irradiation comprising:

a. a substrate transparent to said laser irradiation;

b. a first metal layer deposited onto said substrate;

c. a layer of dielectric material deposited onto said first metal layer; and d. a second metal layer deposited onto said layer of dielectric material.

2. The apparatus as described in claim 1, wherein said second metal layer is thicker than said first metal layer.

3. The apparatus as described in claim 1, wherein said first and second metal layers comprise aluminum.

4. The apparatus as described in claim 1, wherein said layer of dielectric material comprises an aluminum oxide.

5. The apparatus as described in claim 1, wherein said substrate comprises UV-quartz.

* * * * *